US005120006A

United States Patent [19]

Hadzicki

[11] Patent Number: 5,120,006

[45] **Date of Patent: * Jun. 9, 1992**

[54] KITE-LIKE FLYING DEVICE WITH INDEPENDENT WING SURFACE CONTROL

[76] Inventor: Joseph R. Hadzicki, 4489 Caminito Cuarzo, San Diego, Calif. 92117

[ * ] Notice: The portion of the term of this patent subsequent to Jan. 9, 2007 has been disclaimed.

[21] Appl. No.: 462,124

[22] Filed: Jan. 8, 1990

Related U.S. Application Data

[63] Continuation-in-part of Ser. No. 257,859, Oct. 14, 1988, Pat. No. 4,892,272.

[51] Int. Cl.[5] ..... B64C 31/06

[52] U.S. Cl. ..... 244/153 R; 244/155 A

[58] Field of Search ..... 244/153 R, 155 R, 155 A

[56] References Cited

U.S. PATENT DOCUMENTS

| | | | |
|---|---|---|---|
| 2,546,078 | 3/1951 | Rogallo et al. | 244/153 |
| 2,751,172 | 6/1956 | Rogallo et al. | 244/153 |
| 3,086,739 | 4/1963 | Barber | 244/155 A |
| 3,194,520 | 7/1965 | Kurkijian | 244/153 |
| 3,296,617 | 1/1967 | Rogallo | 343/18 |
| 3,310,261 | 3/1967 | Rogallo et al. | 244/44 |
| 3,446,458 | 5/1969 | Rogallo | 244/43 |
| 3,952,975 | 4/1976 | Laske | 244/153 R |
| 3,980,260 | 9/1976 | Laske | 244/153 R |
| 4,029,273 | 6/1977 | Christoffel, Jr. | 244/153 R |
| 4,286,762 | 9/1981 | Prouty | 244/153 R |
| 4,892,272 | 1/1990 | Hadzicki | 244/153 R |

OTHER PUBLICATIONS

Kites, David Pelham, 1976, pp. 173, 175, 90, 186, 187.

Kite Lines Winter ∝ Spring '87, p. 56.

Kite Lines Spring 1988, pp. 26, 57, 87.

*Primary Examiner*—Joseph F. Peters, Jr.

*Assistant Examiner*—Anne E. Bidwell

*Attorney, Agent, or Firm*—David J. Harshman

[57] ABSTRACT

A preferred embodiment of the present invention includes a kite having a sail with a left and right wing, each being connected to a supporting frame, with the frame having a leading edge support member associated with a left wing strut member and with a right wing strut member. It also includes bridle apparatus associated with the frame, the bridle apparatus having a horizontal line member connected to the leading edge support member, a left wing vertical line member connected to the left wing vertical support member, and a right wing vertical line member connected to the right wing strut member. The horizontal line member is connected to the left and right wing vertical line members at upper left and upper right control line contact points. The set of control lines includes an upper left line and an upper right line connected to the upper left and upper right control line contact points. The set of control lines further includes a lower left line and a lower right line connected to lower left and lower right control line points. A left control handle is connected to the upper left and lower left control lines, and the right control handle is connected to the upper right and lower right control lines. The control handle members include a design which mechanically amplifies the reverse flight signals relative to the forward flight control line signals. Also included is a three-line embodiment, an ornithoptic embodiment, and an inflated airfoil construction.

9 Claims, 7 Drawing Sheets h
w
29
30
31
32
33
34
35
36
37
38
39
40
41
42
44
46
48
50
52
54
56
58
60
16
202
204
206
208
74
75
76
78
80
82
84
88
90
35 (36)

Fig. 12
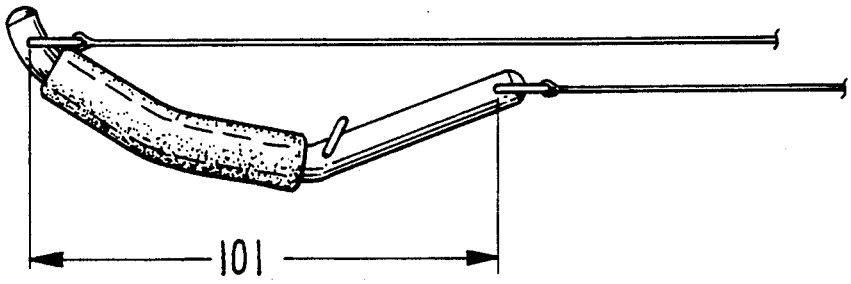
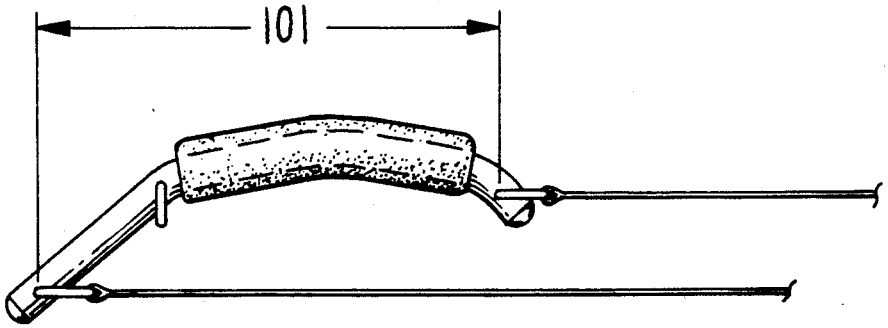
Fig. 13

KITE-LIKE FLYING DEVICE WITH INDEPENDENT WING SURFACE CONTROL

BACKGROUND OF THE INVENTION

This application is a continuation-in-part of co-pending application Ser. No. 257,859, filed Oct. 14, 1988. This invention relates generally to kite-like flying devices. More particularly, this invention relates to a kite-like flying device which is well suited to high performance stunt kite flying.

1. Description of the Prior Art

There have been many kite-like flying devices in the prior art which have been designed to exhibit high performance characteristics in terms of maneuverability, speed, and responsiveness to control signals from the user. In conventional prior art kites, attempts have been made utilizing two strings to control kites. Recent examples of this are disclosed in U.S. Pat. No. 4,286,762 for a kite-like flying device which utilizes two strings. Two strings are connected to a string harness attached at either end of the cross stick. The patent discloses that an operator may cause the kite to move from side to side, loop, dive, sweep, form figure eights, or perform other maneuvers. However, this device has its limitations in terms of its ability to perform such maneuvers and the required use of a control rod, which is an additional element of the device to allow its operation as disclosed in the patent.

There have also been attempts in the prior art for two-line controls of kite-like flying devices, to devise control devices which utilize complicated structures which alter the wing configuration to provide control. For example, in U.S. Pat. No. 3,446,458, there is disclosed a control device for a flexible wing aircraft. However, such devices are designed to allow the wing member configuration to be altered for flexible wing air vehicles. Because of the size and weight of these types of vehicles, such as gliders, powered drones, aircraft, and wings for the recovery of rocket boosters and space capsules, these types of devices are not practical and not well suited to high performance maneuverability.

Other conventional devices in the prior art are those shown in U.S. Pat. No. 3,296,617 for a target kite, and in U.S. Patent No. 2,388,478 for a target kite also. In addition, there have been articles written outlining attempts to provide kites which are capable of responding to controls such as the article published in the May 1945 edition of *Popular Science,* and an article as disclosed in the Fall 1988 issue of *American Kite* at pages 34 through 44. Again, such kites are designed to respond to controls from the ground level, and use of two strings. However, each of these devices is cumbersome to use, and did not permit many maneuvers for which the kite flyer of today desires to perform with the kite.

There are also a number of kites in the past which have used more than two strings or lines to control the flight of the kite. These kites are typically of the delta-wing type. Unfortunately, these kites do not provide as much responsiveness and maneuverability as often desired for recreational or competition kite flying. A plethora of lines alone does not give additional controllability of flight, since the shape of the kite surface, and the location of the points of attachment of the lines to the kite surface play a crucial role in kite flying performance. Conventional kites do not provide independent surfaces whose inclination can be controlled in such a manner as to provide enhanced responsiveness.

The prior art devices thus fail to provide total controllability of a kite-like flying device. Conventional kite-like flying devices cannot be made to easily perform various flying maneuvers including, but not limited to, left and right turns, continuous speed control, reverse flight, instantaneous stopping ability, and a turning radius limited only by the wingspan of the flying device. In addition, prior art kites cannot be flown in wind conditions ranging from extremely light to very heavy.

There are often situations in which it is necessary to fly under conditions which may result in large forces being exerted by the flying kite on the control lines attached to the kite. Such situations may include large kites which have a large surface area. The large surface area generates significant forces as wind-speed conditions increase. Another situation generating large forces is where kites are flown in a stacked or parallel arrangement which is often seen in stunt flying. Stacked kites present a large total surface area which has a cumulative effect which increases the amount of force exerted on the control lines. Various combinations of large kite size, stacked arrangement, and/or heavy winds can result in large forces on the control lines that make it extremely difficult for the user. On multiline kites, the flyer typically uses handles to which the control lines are attached. Large forces exerted by the lines pulling on the handles can cause the flyer's hands and arms to tire relatively quickly, and can even jerk the handles out of the flyer's hands. Yet maintaining control of a plurality of lines is still required to achieve the maneuverability desired.

It is also desirable to achieve artistic style and form in the act of stunt flying of kites. In addition to the path of movements of the kite in the sky, and the speed and accuracy with which it can be directed to so move, action of the kite itself may be important. In other words, it may be desirable to cause the kite, whether moving or stationary while in flight, to change its appearance or shape. One such desired change is to establish or simulate a wing-flapping motion of the kite. Such wing-flapping adds another dimension to the range of controlled movements of the kite.

Another aspect of improving performance of stunt kites, which is a part of the overall kite design, is the construction of the kite. The present invention recognizes that further enhancement of performance can be achieved by incorporating an inflated airfoil into the design of the kite. An inflated airfoil allows for increased aerodynamic efficiency. This allows for higher flight speeds, lower minimum wind conditions, and generally enhanced performance. An inflated airfoil is light, requires less separate structural supporting framework, and is more easily adapted to manufacture of various shapes. Such shapes could include birds, insects, airplanes, and the like to produce the desired visual effects when in flight.

There are many potential stunts that are presently impossible for two-line controlled kites. Unfortunately, current stunt flying competitions which utilize such prior art kites presently consist largely of left/right turning maneuvers. Thus, conventional prior art kites do not sufficiently challenge the kite flyer's skill and imagination.

SUMMARY OF THE INVENTION

It is an object of the present invention to provide a kite-like flying device which is capable of performing various flying maneuvers exhibiting a wide range of controllability.

It is a further object of the present invention to provide a kite-like flying device which is capable of left and right turns, continuous speed control, reverse flight, instantaneous stopping ability, and a turning radius limited only by the wingspan of the flying device.

It is yet another object of the present invention to provide a kite-like flying device which is easy to use and is reliable.

It is yet another object of the present invention to provide a kite-like flying device and method of operating same which is simple and efficient to manufacture and use.

It is yet another object of the present invention to provide a kite-like flying device which permits performance of such flying maneuvers under relatively large load conditions.

It is another object of the present invention to provide a kite-like flying device which permits performance of such flying maneuvers while controllably changing the shape of the device, such as to establish a wing-flapping movement.

It is another object of the present invention to provide a kite-like flying device which may include an inflated airfoil in its design.

Further objects of the present invention will become apparent in the full description of the invention taken in conjunction with the drawings as set forth below.

A preferred embodiment of the present invention includes a kite having a sail with a left and right wing, each being connected to a supporting frame, with the frame having a leading edge support member associated with a left wing strut member and with a right wing strut member. It also includes bridle means associated with the frame, the bridle means having a horizontal line member connected to the leading edge support member, a left wing vertical line member connected to the left wing vertical support member, and a right wing vertical line member connected to the right wing vertical support member. The horizontal line member is connected to the left and right wing vertical line members at upper left and upper right control line contact points. The set of control lines includes an upper left line and an upper right line connected to the upper left and upper right control line contact points. The set of control lines further includes a lower left line and a lower right line connected to lower left and lower right control line points. A left control handle is connected to the upper left and lower left control lines, and the right control handle is connected to the upper right and lower right control lines. A venting screen is located along a leading edge of the sail. The control handle members include a design which mechanically amplifies the reverse flight signals relative to the forward flight control line signals.

In another embodiment of the present invention which incorporates independent wing surface control, the line and bridle arrangement is modified to accommodate large load conditions. Such large load conditions can occur with multiple stacking of the kite, or with enlarged versions which have a relatively large surface area. The large load embodiment uses three lines. The left and right upper control line bridle contact points are combined into one upper central bridle contact point. One line is connected to the upper central bridle contact point to serve as an anchor line. This anchor line is not intended to be manipulated to control flight. It serves as a reference line for the kite about which control can be effected. The anchor or reference line is preferably connected to the body of the user, such as to a pelvic harness, near the center of gravity of the user for stability. The left and right lower control line contact points remain the same. The lower control lines are connected to handles for each the left and right hands. The amount of anchor line which is let out establishes the height of the kite in the sky. The inclination of the left and right wing surfaces with respect to each other may be independently varied by pulling action on the left and right lower control lines.

In yet another embodiment of the present invention which incorporates independent wing surface control, an ornithoptic-type configuration is provided. An arrangement using either five or six control lines is used with a modified wing design using flexible joints to establish a wing-flapping motion. This embodiment comprises three independently controllable wing surfaces attached side-by-side. A left wing surface and a right wing surface are each flexibly attached to a central wing surface section. The left and right wing surfaces each have upper and lower control line contact points, as in the first embodiment. There is also included upper and lower contact points attached to the central wing surface. Specially modified three-point control handles are provided, with the upper central control line attached to one handle, and the lower central control line attached to the other handle. Alternatively, one anchor line attached to the effective center of the central wing surface may be connected to a pelvic harness. Proper manipulation of the handles allows wing-like flapping motion while the kite is in flight.

Finally, another embodiment of the present invention, which incorporates independent wing surface control, uses an inflated airfoil construction. A sheet of monocoat balloon sheeting material is sealed to provide an airtight chamber, which is inflated with pressurized air. It is aerodynamically thin and shaped to approximate the design of the earlier kite embodiments. This embodiment is pressurized sufficiently to be stiff enough to provide necessary structural support. The material used is sufficiently strong, yet light, such as mylar. This inflated airfoil construction may be conveniently incorporated into the designs specified herein.

BRIEF DESCRIPTION OF THE DRAWINGS

FIGS. 12 and 13 show control handle positions during full-forward control signal, and full-reverse control signal, respectively.

DESCRIPTION OF A PREFERRED EMBODIMENT

Figure 1:
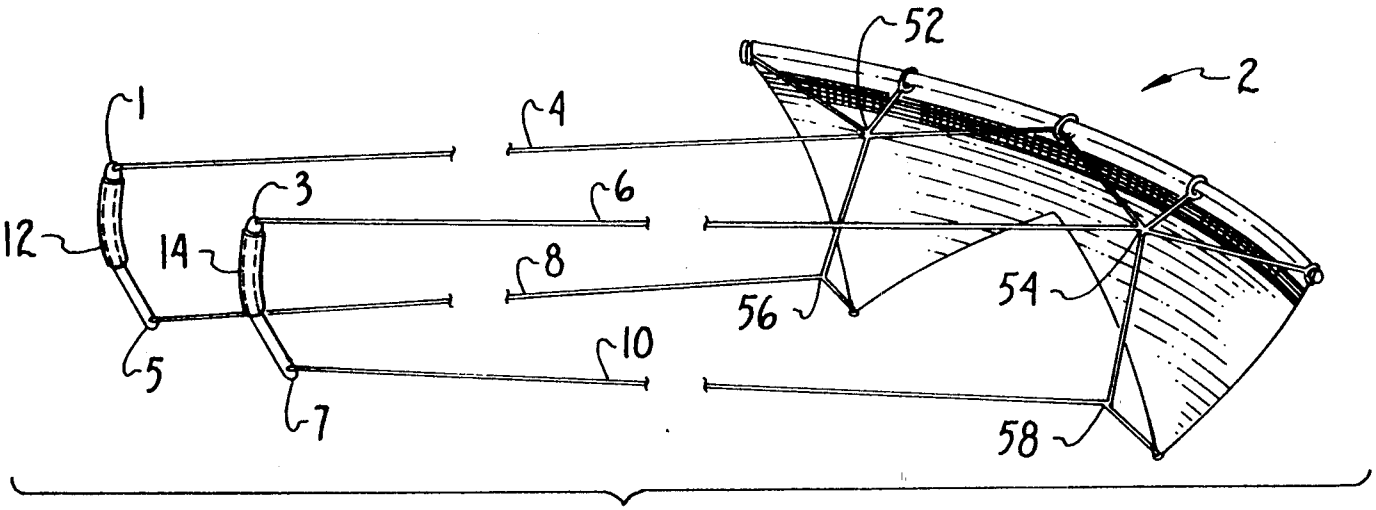
FIG. 1 is a perspective view of a preferred device according to the invention while in flight.

As shown in FIG. 1, a preferred embodiment of the invention includes a kite assembly 2, control strings 4, 6, 8, and 10, and left and right control handles 12 and 14.

Figure 2:
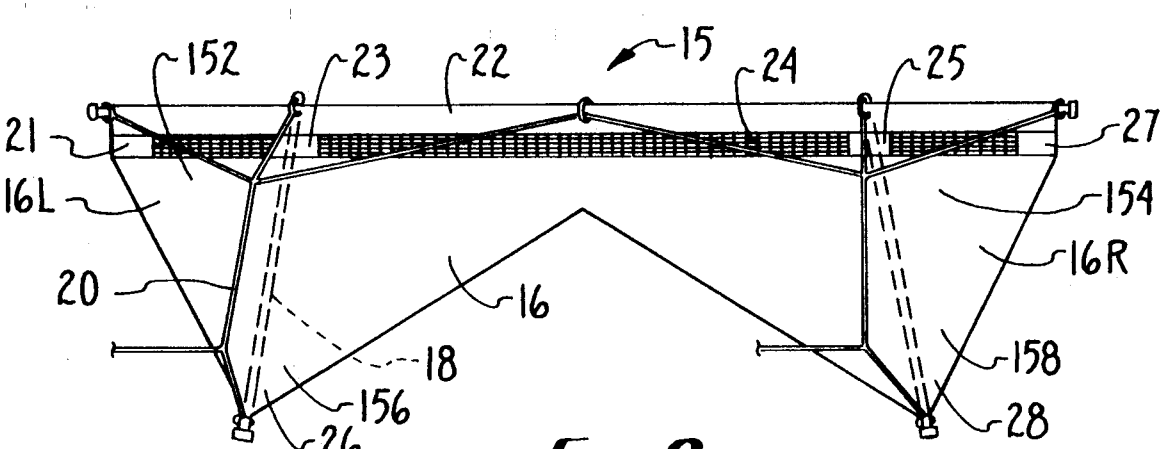
FIG. 2 shows a preferred embodiment of the kite assembly portion of the invention.

The kite assembly 2, shown in FIG. 2, comprises a sail assembly 15, skeletal structure 18, and harnessing bridle 20.

The sail assembly 15 includes of a leading edge sleeve 22, of lightweight, flexible sheet material, such as resin-impregnated Dacron Polyester fabric, a venting screen 24, made of a suitable flexible porous material which allows air to easily pass through, such as plastic-coated fiberglass mesh, and a double-V-shaped sail 16, of suitable lightweight flexible sheet material, such as resin-impregnated ripstop Nylon fabric. The sail 16 has a left wing portion 16L and a right wing portion 16R. The high-stress points of the venting screen 24, and lower wingtip portions 26 and 28, are reinforced using panels 21, 23, 25, and 27, of stronger sheet material such as resin-impregnated Dacron fabric.

Figures 3, 4, 5, 6, 7, 8:
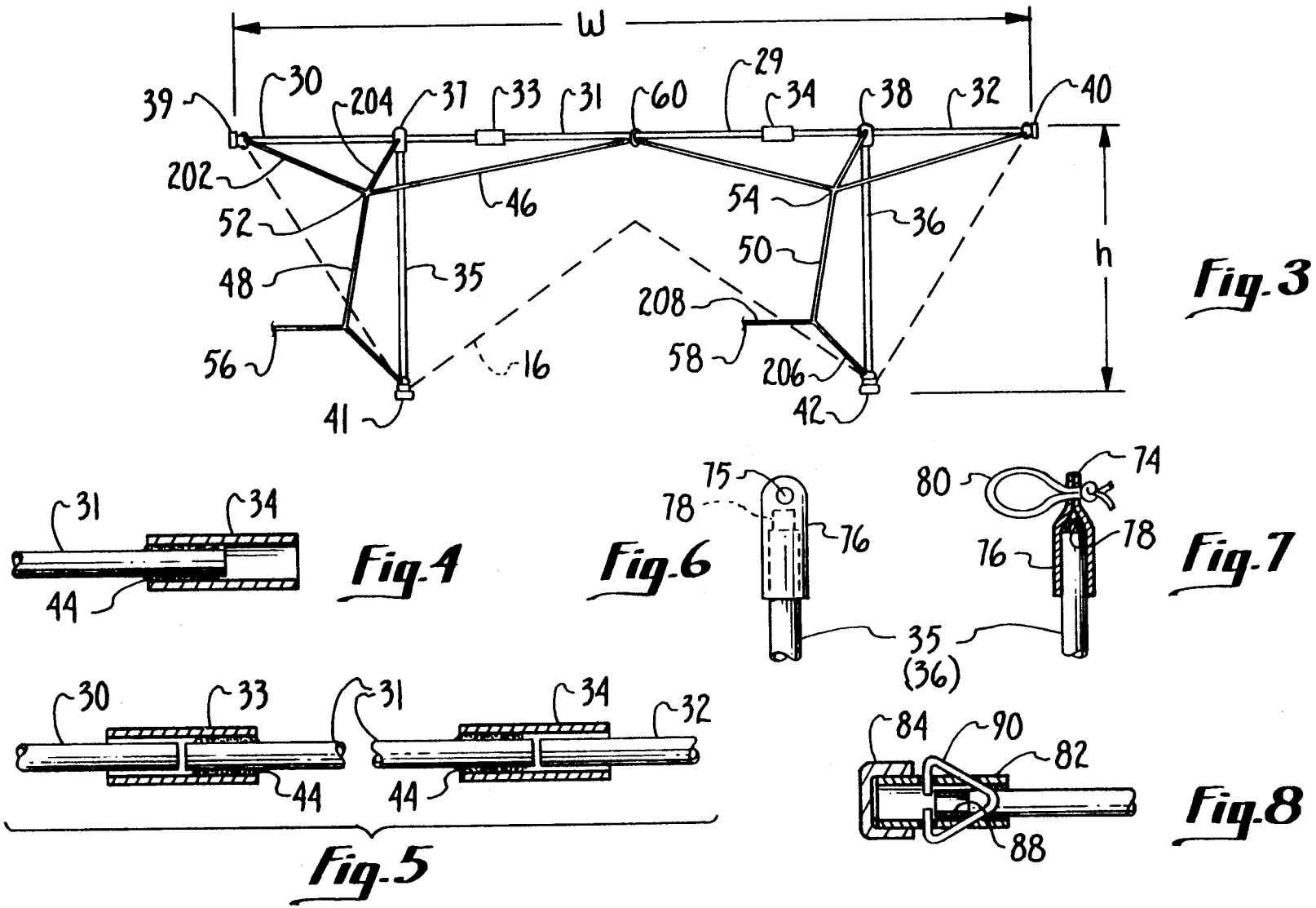
FIG. 3 shows a preferred skeletal structure assembly and harnessing bridle.
FIGS. 4 and 5 are sectional views of a preferred construction for the leading edge support structure.
FIGS. 6 and 7 show a preferred embodiment and sectional view of the wing strut cap assembly.
FIG. 8 is a sectional view of an end plug assembly.

Referring now to FIG. 3, there is shown the skeletal structure having leading edge support member 29. In the embodiment shown, it comprises tubular members 30, 31, and 32 joined by joint members 33 and 34. Connected to the support member 29 is a left wing strut member 35 and a right wing strut member 36. They are held in place by means of left and right wing strut connecting asemblies 37 and 38 coupled to leading edge support member 29, and end-plug assemblies 39, 40, 41, and 42 fixed to respective edges of sail 16.

The tubular members 30, 31, and 32, constituting the leading edge support member 29, and struts 35 and 36 constituting the skeletal structure, are made of a lightweight and strong yet resilient material, such as graphite/S-glass composite reinforced plastic tube. The horizontal length w of leading edge support member 29 is approximatly three times that of the height h of the struts 35, 36. A preferred dimension that works well is 9 feet wide, and 3 feet high, kite-like device.

FIGS. 4 and 5 show the connecting method employed at the leading edge splicing joints 33 and 34. The splicing elements 33 and 34 are fabricated from aluminum tubing with an inside diameter sufficiently large enough to allow a sliding fit of the tubular skeletal members. The splicing elements 33 and 34 are joined to both ends of the central leading edge tubular member 31 using an epoxy adhesive 44 as shown in FIG. 5. This allows tubular member 30 to slide into the splicing element 33 and tubular member 32 to slide into splicing element 34.

In FIGS. 6 and 7 the wing strut members 35 and 36 are slidably connected at the leading edge of the kite using wing strut connecting members 37 and 38. FIG. 6 shows a frontal view of one of the wing strut connecting members 37, and which has the same construction as the other wing strut connecting member 38. The wing strut connecting member 37 comprises a wing strut cap 76 formed from a small section of aluminum tubing. The top edge of the wing strut cap 76 is crimped and has a hole 75 through it. FIG. 7 shows a cross section of the wing strut cap 76. Inside the aluminum tube of the wing strut cap 76 is a small shock absorbing element 78, such as a piece of polyvinyl tubing. The wing strut 35 fits into the open ends of the wing strut caps 76 and rests against the shock absorbing element of polyvinyl tubing 78. A loop of cord 80, such as Nylon, passes through the wing strut cap hole 75 and is attached by encircling the leading edge support member 29 directly above the reinforcement panels 23 and 25. Wing strut 36 is likewise similarly connected. Thus it can be appreciated that rather than rigid attachment there is total freedom of movement between the leading edge support member 29, and the wing struts 35, 36.

FIG. 8 shows an end plug assembly employed at 39, 40, 41, and 42 (FIG. 3). The end plug assembly has a number of purposes. It is used to attach the sail assembly 16 to the skeletal structure. Another purpose is to protect the ends of the tubular structural members upon impact. Finally it helps to prevent injury in case of accidental impact. The end plug is made of a section of tubing 82. At one end of the tube is a rubber cap 84. The other end of the tube is open to accept the slide-fitting structural tubular members 30, 32, 35 and 36 which rest against a small section of polyvinyl tubing 88, which acts as a shock absorbing element. A triangular clip 90 is inserted and compressed into holes through the end plug 82.

Figure 9:
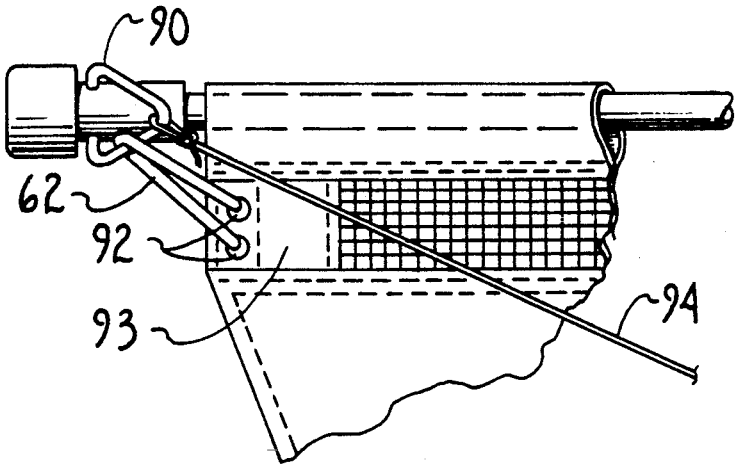
FIG. 9 shows the left wingtip area including end plug connecting members.

As shown in FIG. 9, an elastic cord 62 forms a loop which passes through the triangular clip 90, and the two holes 92 in the reinforcement panel 93. FIG. 9 also shows the typical bridle attachment method. Bridle line 94 is typical of the horizontal and vertical bridle line attachments made at end plug assemblies 39, 40, 41, and 42.

FIG. 3 further shows the bridle arrangement made of strong line, such as high-test braided Dacron line. The bridle arrangement consists of horizontal bridle line member 46 and vertical bridle line members 48 and 50. The horizontal bridle line 46 is anchored at the end plug assemblies 39 and 40 as shown in FIG. 9. The center part of the horizontal bridle line passes through the midpoint 60 of the leading edge sleeve 22, and encircles the tubular member 31. The upper end of the vertical bridle lines 48 and 50 are connected to the cord loop 80 of the wing strut connecting members 37 and 38. The lower ends of the vertical bridle lines are attached to the end plugs in the conventional manner (see FIG. 9). The horizontal line 46 and vertical lines 48 and 50 intersect near the leading edge at upper left and right control line contact points 52 and 54, respectively. The lower left and right control line contact points 56 and 58 are adjustably located near the lower wing tip end plugs 41 and 42. Positioning of bridle control points 52, 54 is critical since horizontal placement toward the center of the kite causes a loss of control and sensitivity. Conversely, horizontal placement away from the center of the kite tends to cause excessive flexing of the leading edge structure.

One set of bridle line adjustments that has been found to work well for a kite having a wingspan w of about 9 feet, is one having an outside bridle line 202 of about 24½ inches, inside bridle line 46 of about 31 inches to the center 60, an upper vertical line 204 of about 9½ inches, a center section vertical line 50 of about 25½ inches, and lower section vertical line 206 of about 10 inches, and a lower extension line 208 of about 10 inches. The same relative dimensions would be scaled accordingly if the device were larger or smaller than that disclosed, to maintain this relationship in this particular embodiment.

As further shown in FIGS. 1 and 2, the extreme ends of the control lines 4, 6, 8 and 10 are attached to the kite at the contact points 52, 54, 56 and 58, and to the control handles 12 and 14 at points 1, 3, 5 and 7, respectively. The four lines allow the controller to affect the angular relationship between four sections (upper left wing 152, lower left wing 156, upper right wing 154, lower right wing 158) of the sail surface 16. This in turn affects wind flow patterns causing left, right, fore and aft pitching motions, which allow the kite to maneuver at any speed, in any direction of the hemispherical flight path.

The importance of the handles shown in FIG. 1, is their ability to incline and decline their respective sail surfaces. The left handle controls the inclination/declination of the left wing portion of the sail 16 while the right handle controls the inclination/declination of the right wing portion of the sail 16.

Figure 11:
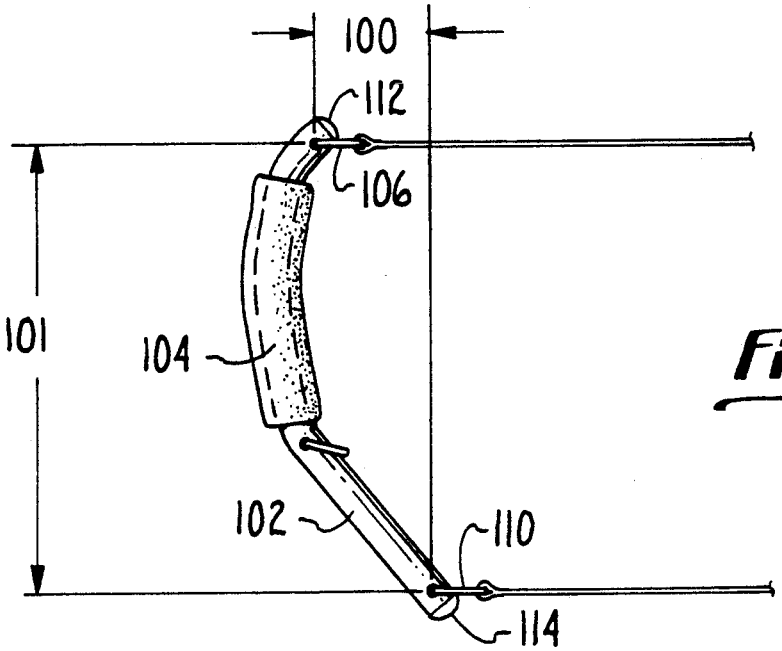
FIG. 11 shows a preferred embodiment of the control handle.

FIG. 11 shows in detail a typical control handle design, including handle structure 102, manufactured from a rigid material such as aluminum tubing, foam rubber handle grip 104, triangular connector clips 106 and 110, and rubber end plugs 112 and 114.

A typical range for the horizontal dimension 100, ranges approximately from one inch to five inches, while the vertical dimension 101, may range from approximately four inches to nine inches.

Figure 14:
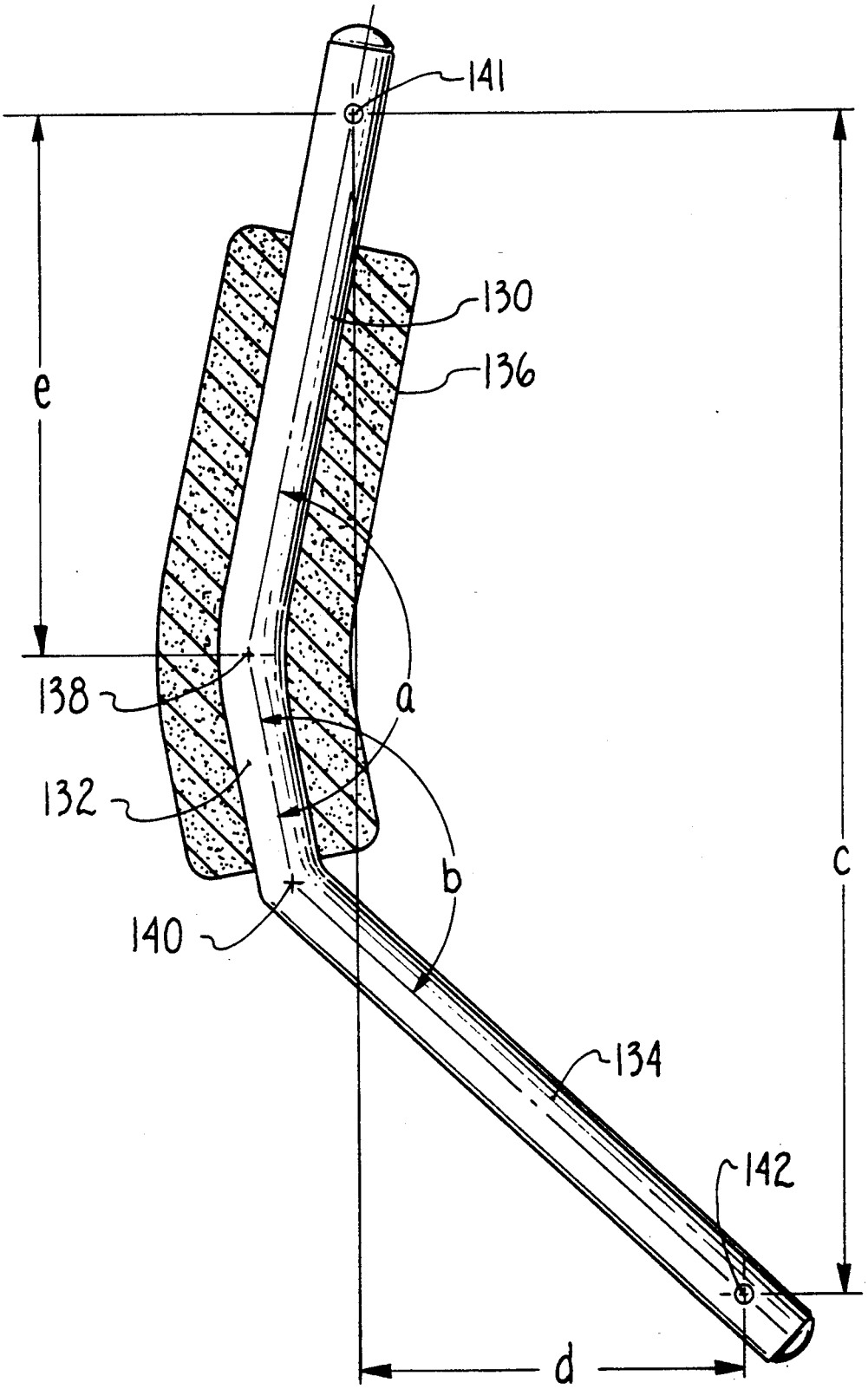
FIG. 14 is a side view of an embodiment of the control handles in accordance with the present invention.

FIG. 14 shows in additional detail a preferred control handle design, the handle having top portion 130, center portion 132, and bottom portion 134, covered by soft handle covering 13.. Handle portions 130 and 132 are connected at point 138 to form an angle of about 158 degrees. Handle portions 132 and 134 are connected at point 140 to form an angle b of about 143 degrees. The vertical distance c between the top and bottom line contact points 141, 142 of the handle is about 9 inches, and the horizontal distance d between the top and bottom line contact points 141, 142 is about one-third this distance, i.e. 3 inches. The vertical distance between top line contact point 141 and point 138 about which the user's hand would pivot, is about 4.125 inches. These relative relationships appear to give the appropriate amount of amplification to the control signal as mentioned further herein.

A very important characteristic of the control handle device is its capability to produce stable reverse flight. Due to the unique handle design, reversing control signals are mechanically amplified relative to forward control signals. Consider the control handle position of FIG. 11 which produces a steady forward flight pattern in which the relative signal between upper and lower control points 106 and 110 is zero. By rotating the handle backward to the full forward position shown in FIG. 12, the relative signal between the upper and lower control points is now the distance 101 minus the initial position of FIG. 11, which was distance 100. Therefore, the relative difference between the initial position of FIG. 11 and the full-forward position of FIG. 12 is distance 101 minus distance 100. Now consider a full-reverse signal shown in FIG. 13. The relative difference between the initial position shown in FIG. 11 and the full-reverse position shown in FIG. 13 is distance 101 plus distance 100. In practice, this amplification of the reversing signal is sufficient to produce instantaneous stopping from forward flight velocities in excess of 50 miles per hour. The reversing amplification also allows reverse flight during any point in the flight cycle including, but not limited to reverse lift-off from the ground, with the kite initially in a nose-down position Sensitivity adjustments can be made by adjusting the lower bridle control line contact points 56 and 58 shown in FIG. 3.

Figure 10:
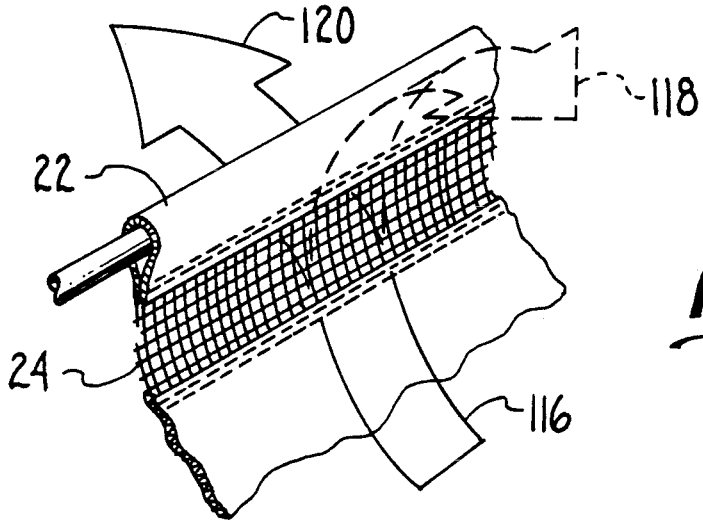
FIG. 10 is a diagrammatic representation of air-flow characteristics of a vented and unvented leading edge during reverse flight conditions.

FIG. 10 exemplifies the airflow characteristics occurring at the leading edge during reverse flight conditions. The purpose of the venting screen 24 is to vent airflow during reverse flight and during tight-turning-radius maneuvers. In reverse flight, the relative air motion 116, is from the aft portion of the sail toward the leading edge 22. In the absence of the venting screen, under the reverse flight conditions, an air pocket is formed in the sail at the leading edge which acts as an air-breaking mechanism, which causes the airflow to backup 118. By venting the leading edge area of the induced air pocket, the air-breaking action is significantly reduced by allowing a large portion of the airflow 120 to continue through the restrictive leading edge area. This in turn greatly improves the reverse flight characteristics of the device.

Secondly, this venting improves the turning characteristics of the kite. A turn is produced when the leading wing of the sail flies faster relative to the trailing wing of the sail. This occurs when the leading wing portion experiences greater lift than the trailing wing portion. By reducing the trailing wing air speed to zero, the trailing wingtip becomes the center of rotation. On presently available flying devices, the above conditions represent the tightest turn radius possible. In other words. the minimum turn radius attainable in presently available stunt kites is a radius of one wing span. By venting the sail, the turn can be optimized by zeroing and then reversing the flight direction of the trailing wing. The turn radius is reduced to one-half of one wingspan, producing a controlled propeller-like spinning action, heretofore unheard of in the prior art.

It may be appreciated by those skilled in the art that the vertical support members 35, 36, described as struts, could also be any suitable framework which performs the same function of a brace fitted into the skeletal structure to allow the sail to resist pressure.

Figure 15:
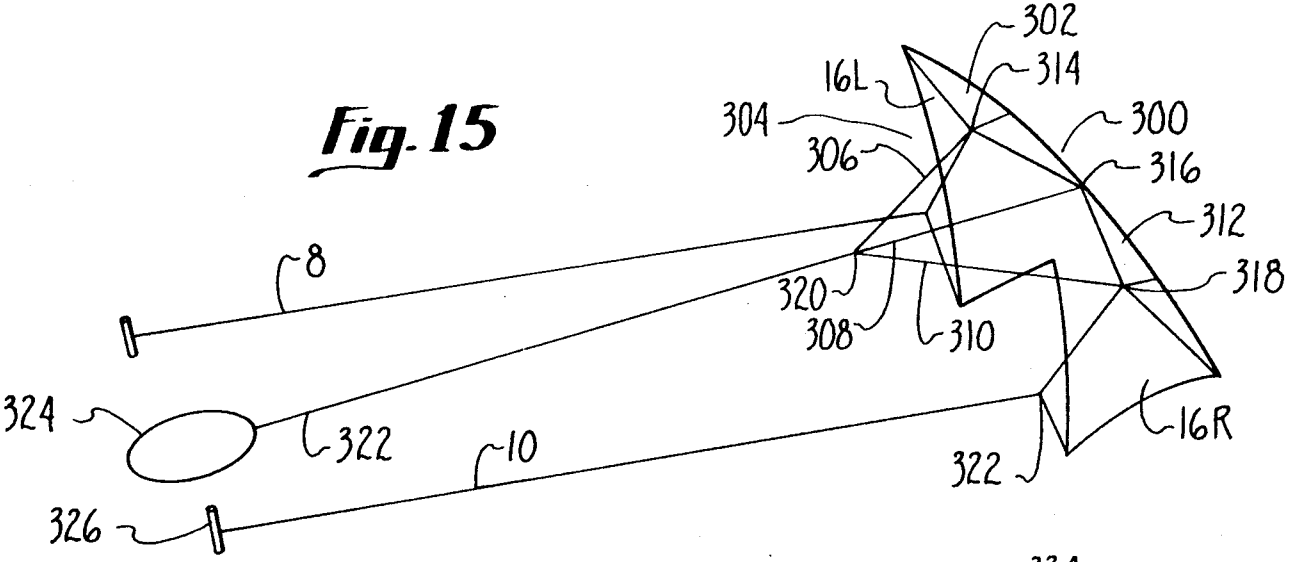
FIG. 15 is a perspective view of an alternative embodiment of the present invention using three control lines adapted for heavy load conditions.

Referring now to FIG. 15, there is shown an alternative embodiment of the present invention which incorporates independent wing surface control. In particular, there is shown a kite assembly 300 comprising a double V-shaped sail 302. Sail 302 is supported in its shape by skeletal structure (not shown) similar to that shown and described in the earlier embodiment of FIGS. 1–3. This alternative embodiment, however, uses an additional upper control bridle 304 to establish a three-line control system.

In particular, upper control bridle 304 is a flexible line bridle which has bridle lines 306, 308 and 310 attached together at one point 320. Bridle lines 306, 308 and 310 are attached to assembly 300 via bridle 312, which can be the same bridle as that of the embodiment of FIGS. 1-3. Bridle line 306 is a left bridle line attached to upper left control point 314. Bridle line 308 is a central bridle line attached to central control point 316. Bridle line 310 is a right bridle line attached to upper right control point 318. The attachment of upper control bridle 304 effectively establishes one upper control point at point 320 where the bridle lines 306, 308 and 310 converge together. Attached to control point 320 is an upper control line 322. The opposite end of upper control line 322 is attached to an object solidly attached to the torso of the user to effectively anchor the kite 300 when in flight. In the embodiment shown, line 322 is attached to a pelvic harness 324, which is worn about the pelvis of the flyer. A shoulder attachment or other body strap could be used, but preferably a connection near the center of gravity of the flyer is preferred. This causes the least amount of work by the flyer and conveniently takes advantage of the flyer's body weight.

A lower left line 8 and lower right line 10 are attached to bridle 312 at lower left attachment point 323 and lower right attachment point 325, respectively. Each line 8 and 10 is connected to respective handles 326, which is to be held in each hand of the flyer.

By thus combining the upper control points into a single upper control line 322, the upper control line becomes an anchor or reference point about which the inclination of each wing surface 16L and 16R may be independently manipulated and controlled by lower left and right control lines 8 and 10, respectively. Since this design does not require manipulation of the upper control line 322, it may be attached or anchored solidly to the center of gravity of the flyer. Thus, this embodiment may be effectively used without quickly tiring the flyer for situations in which there are high load conditions. Such high load conditions would typically be found in use of designs for large kites, or where the kites are stacked. In such situations, because of the large surface area, high load conditions on the lines can develop rapidly when wind forces increase. The flyer is conveniently anchored to the kite assembly 300 with the flyer's body weight, and control is effected by moving lower control lines 8 and 10 together, or independently, forward and aft to independently control inclination of the surfaces 16L, 16R, and thus control flight.

Figure 16:
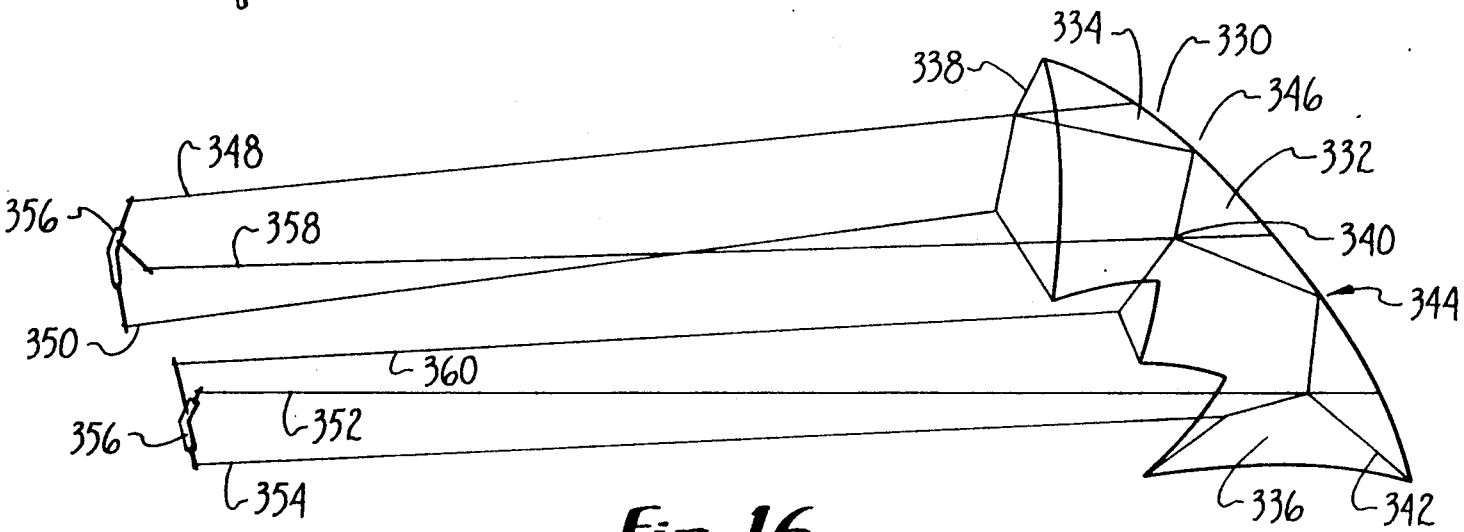
FIG. 16 is a perspective view of an alternative embodiment of the present invention adapted to provide ornithoptic motion.

In FIG. 16, there is shown another embodiment in which a W-shaped kite assembly 330 includes a central wing surface 332, in addition to left wing surface 334 and right wing surface 336. Left and right wing control and bridle lines 338, 342 are respectively attached to left and right wing control surfaces 334, 336. In addition, a center section control and bridle line 340 is attached to center wing surface 332. Kite assembly 330 includes flexible joints 344, 346 connecting wing surface sections 332, 334 and 336 together. Left upper and lower control lines 348, 350 and right upper and lower control lines 352, 354 are connected to the respective left and right bridles 338, 342, and to three point handles 356. Center control lines 358, 360 are connected to center bridle 340, and also to three point handles 356. Manipulation of the inclination of left and right wing surfaces 334, 336 can be effected by the handle in accordance with the earlier explanations given herein. Simultaneously, central wing surface 332 can be moved toward and away from the flyer by rotating three point handles 356 to move left and right central control lines 358, 360 forward and aft. This establishes a flapping motion of kite assembly 330, since flexible joints 344, 346 allow articulation of wing surfaces 334, 336 of kite assembly 330 about these joints. Alternatively, the two center lines 358, 360 could also be combined into one line if so desired, so the flyer could move handles 356 forward and aft to establish a wing-flapping motion while kite assembly 330 is in flight.

Figure 17:
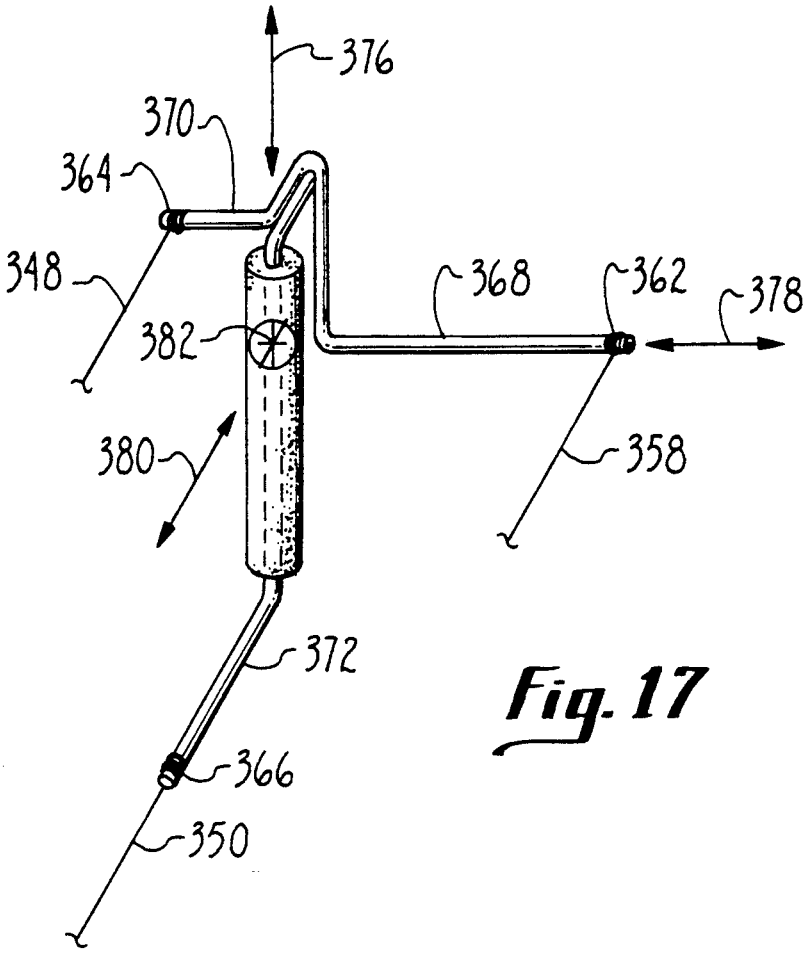
FIG. 17 is a perspective view of an alternative embodiment of a left handle for use with the embodiment shown in FIG. 16.

Shown in more detail in FIG. 17 is three point handle 356 for use in the left hand. Handle 356 has line control contact points 362, 364 and 366. Point 362 is at the end of rigid bar 368 which is oriented horizontally and extends along a y-axis 378 inward toward the center of the flyer's body. This point 362 is connected to center line 358. Point 366 is at the end of rigid bar 372, which bar 372 is fastened to bar 368 parallel to z-axis 380 at a right angle to axis 378. Point 366 is connected to lower left control line 350. Point 364 is located at the end of bar 370, which is connected to bar 372 generally in a direction along the y-axis 378, but offset a predetermined distance above y-axis 378, and on the other side of vertical x-axis 376. The distances of points 362, 364 and 366 from origin 382 determine the amount of amplification of the control signal generated by movement of handle 356, as a function of the square of the distance. A preferred material is stainless steel tubing, but other light rigid materials are suitable.

Figure 18:
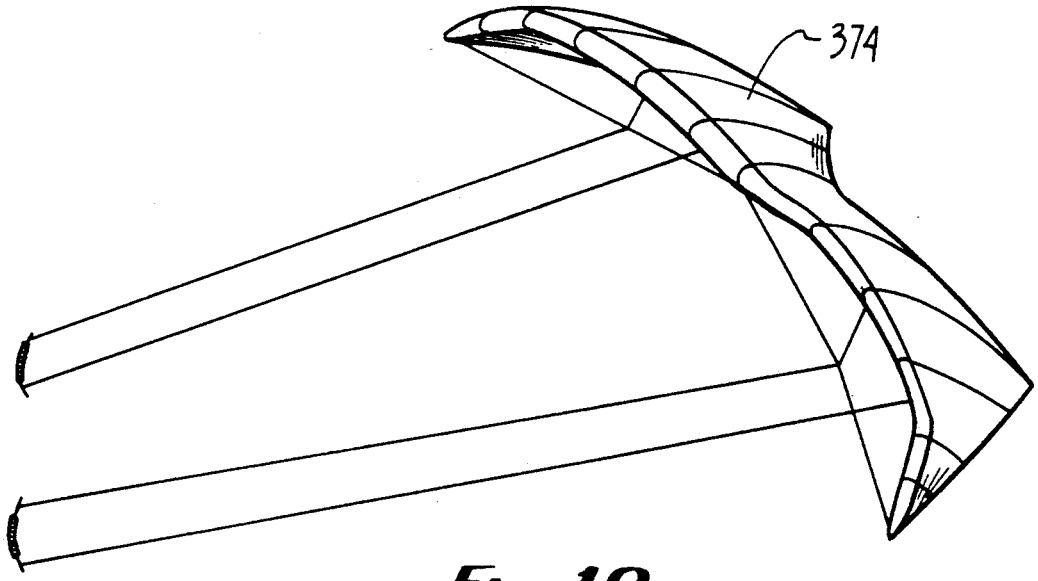
FIG. 18 is a perspective view of an alternative embodiment of the present invention using an inflated airfoil construction.

Finally, there is shown in FIG. 18 an inflated airfoil design of kite assembly 374. It comprises a light, flexible airtight material such as mylar, in which pressurized air is contained to form a V-shaped kite. The same bridle and control as in the earlier embodiments may then be included. This manner of construction allows for various other shapes, provided there are at least two independently controllable wing surfaces, and has lighter weight.

Although the present invention has been shown and described in terms of specific preferred embodiments, it will be appreciated by those skilled in the art that changes or modifications are possible which do not depart from the inventive concepts described and taught herein. Such changes and modifications care deemed to fall within the purview of these inventive concepts. Thus, it should be noted that the accompanying description and drawings are meant to describe the preferred embodiments of the invention, but are not intended to limit the spirit and scope thereof.

I claim:

1. A kite-like flying device comprising:

a left wing surface having an upper portion and a lower portion;

a right wing surface having an upper portion and a lower portion;

a central body surface positioned between and flexibly connected to said left and right wing surfaces to allow each said wing to articulate about said body;

left control means associated with said upper and lower portion of said left wing surface for controlling inclination of said left wing surface;

right control means associated with said upper and lower portion of said right wing surface for controlling inclination of said right wing surface; and central control means associated with said central wing surface for moving said central wing surface forward and aft of said left and right wing surfaces to establish ornithoptic movement.

2. A kite-like flying device as recited in claim 1, wherein said left and right control means each comprise an upper and lower control line connected to said upper and lower portions.

3. A kite-like flying device as recited in claim 2, wherein said central control means comprises a center section bridle connected to a pair of central control lines.

4. A kite-like flying device as recited in claim 3, further comprising a handle having a first point to establish a connection to said upper control line, a second point to establish a connection to said lower control line, and a third control point to establish a connection to one of said central control lines.

5. A kite-like flying device as recited in claim 4, further comprising a left handle and a right handle, said handles being mirror images of one another.

6. A handle for controlling flight of a kite, comprising:

a substantially straight top portion having one end attached to a control line to establish top handle contact points;

a substantially straight center portion connected to said top portion at a pivot point, and forming an angle with said top portion of about 158 degrees; and a substantially straight bottom portion connected to said center portion forming an angle with said center portion of about 143 degrees, and having one end attachable to a bottom control line to establish a bottom line contact point;

said top and bottom contact points having a vertical and horizontal distance therebetween, said horizontal distance being about one-third said horizontal distance.

7. A handle for controlling flight of a kite as recited in claim 6, wherein said top contact point and said pivot point have a vertical distance therebetween of about 1.25 said horizontal distance.

8. A, handle for controlling flight of a kite as recited in claim 7, further comprising a soft layer covering said center portion.

9. A kite-like flying device comprising:

a first wing surface for providing resistance to air flow, said first surface having an upper portion and a lower portion;

a second wing surface movably connected to and adjacent said first surface for providing resistance to air flow, said second surface having an upper portion and a lower portion;

upper control means connected to said upper portion of said first and second wing surfaces for establishing an upper pivot; and first lower control means connected to said lower portion of said first wing for controllably establishing a first angle of inclination of said first wing and second lower control means connected to said lower portion of said second wing for controllably establishing a second angle of inclination of said second wing;

said first and second lower control means being independently controllable for establishing said first angle of inclination which may be different from said second angle of inclination, wherein said wing surfaces comprise an inflated airfoil.

* * * * *